United States Patent [19]

Lund

[11] 4,152,828

[45] May 8, 1979

[54] RAZOR HAVING VARIABLE ANGLE AND TILT OF ITS BLADE

[76] Inventor: Lloyd W. Lund, Chapel Rd., Waldoboro, Mass. 04572

[21] Appl. No.: 891,313

[22] Filed: Mar. 29, 1978

[51] Int. Cl.[2] ..... B26B 21/52

[52] U.S. Cl. ..... 30/89

[58] Field of Search ..... 30/87, 88, 89, 340; 403/58, 86, 93, 95

[56] References Cited

U.S. PATENT DOCUMENTS

| | | | |
|---|---|---|---|
| 880,735 | 3/1908 | Heissenberger | 30/87 X |
| 1,455,750 | 5/1923 | Hartman | 30/89 X |
| 1,639,441 | 8/1927 | Spahr | 30/89 |
| 2,820,288 | 1/1958 | Malecki | 30/89 X |
| 3,879,146 | 4/1975 | Mayer | 403/93 |
| 3,955,277 | 5/1976 | Pomfret | 30/47 |

*Primary Examiner*—Gary L. Smith

*Attorney, Agent, or Firm*—Ernest F. Marmorek

[57] ABSTRACT

A razor comprises a handle and a blade holder supporting at least one razor blade. To employ the blade for a slicing action in addition to the shearing one, an off-center universal joint connects the blade holder to the handle of the razor; a leaf spring attached at one end to the handle and atits free end abuts against the center member of the movable joint and against the blade holder which thus automatically resumes a neutral or normal shaving position. The angle of attack of the blade can be adjusted simply by twisting the handle and the blade, and the universal joint at the same time tilts the blade holder to follow the contour of the face.

10 Claims, 4 Drawing Figures

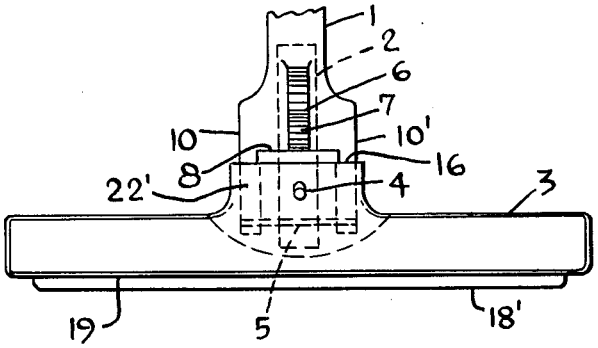
Fig 2
Fig 3
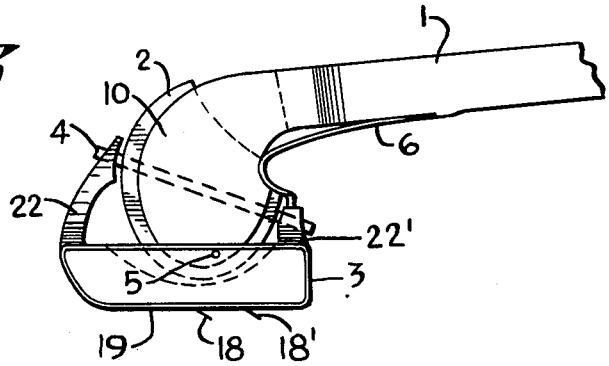
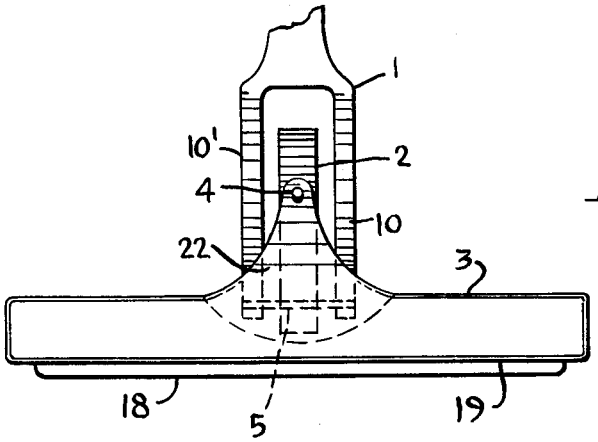
Fig 4

RAZOR HAVING VARIABLE ANGLE AND TILT OF ITS BLADE

BACKGROUND OF THE INVENTION

This invention relates generally to a safety razor and, more particularly, it relates to a razor having an adjustable shaving blade.

In conventional safety razors, the shaving blade is arranged usually at right angles to the handle, and is firmly mounted in a blade holder, so that during the strokes of the razor operator, the hair is cut by the shearing action of the blade.

Razors have been known that shave by slicing action of the blade instead of the shearing one. For this purpose the razor blade has been fixedly mounted at an acute angle relative to the axis of the handle. The drawback of such arrangement, however, is evidently in the fact that the fixed leading angle of the blade is permanently adjusted for a slicing operation and there is no possibility of switching to the normal shearing of the hair during the shave.

In another embodiment of a prior art the razor-blade holder has been made tiltable so as to follow the contour of the face. But even in this tiltable design, the lateral angle of the razor blade, relative to the handle, is made permanent and cannot be changed during the shaving.

SUMMARY OF THE INVENTION

It is the primary object of this invention to avoid the disadvantages of prior art razors and to provide a razor having a variable lateral angle of its blade relative to the handle, and which at the same time can be tilted in a plane normal to the handle, to follow the contour of the face.

Another object of this invention is to provide a razor where the variation of the lateral angle and the tilting can be made during the shaving operation.

A further object of this invention is to provide a razor that automatically returns to, and keeps a normal shearing position.

Still another object of this invention is to make a razor which is simple in construction and low in manufacturing cost.

According to this invention, the above objects and others, as will be explained hereinafter, are attained by employing an off-center universal joint between the blade holder and the handle, and a return spring for resiliently engaging the central block of the universal joint and the holder to hold the latter in a neutral shaving position, but to allow an angular displacement of the holder from this neutral position. The universal joint has an outer fork that is firmly connected to one end of the handle, a central joint block or member tiltably supported in the outer fork for swinging about a transverse axis intersecting the axis of the handle about right angles, an inner fork having its prongs firmly connected to the blade holder at the central area of its long sides, the inner fork with the blade holder being tiltably supported in the tiltable central joint block or member for swinging about a second axle extending above the first mentioned tilt axle, and being substantially at right angles thereto; the first tilt axle is preferably located below the center of the central joint block, whereas the second axle intersects the central area of the central joint block.

For a fuller understanding of the nature and objects of the invention, reference should be had to the following detailed description, taken in connection with the accompanying drawing.

BRIEF DESCRIPTION OF THE DRAWING

FIG. 2 is a rear view of an assembled razor of this invention;

FIG. 3 is a side view of the razor of FIG. 2; and

FIG. 4 is a front view of the razor of FIG. 2.

DESCRIPTION OF THE PREFERRED EMBODIMENTS

Figure 1:
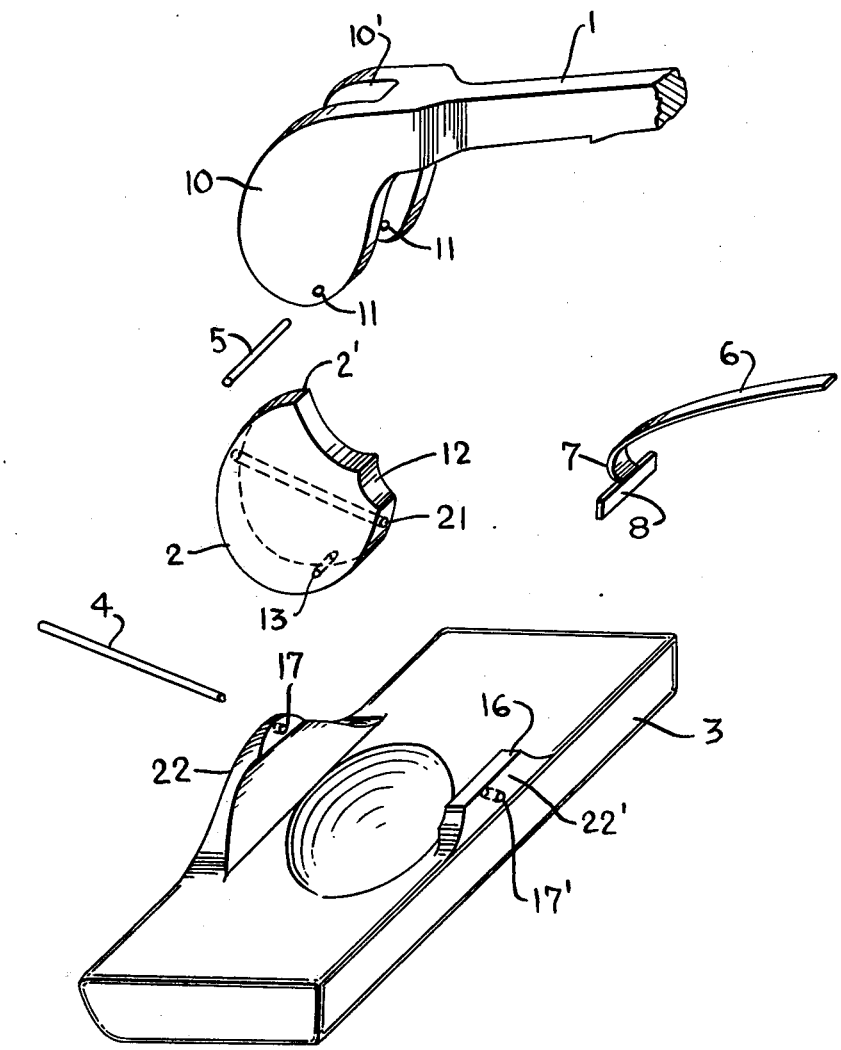
FIG. 1 is a perspective exploded view of the razor of this invention.

Referring now to FIG. 1, there is shown an exploded view of handle 1, connected at one end thereof with an outer fork having prongs 10 and 10', each defining a hole 11 to receive a pin forming the tilt on the first axle 5. Reference numeral 2 denotes a central block or member of the universal joint, the block having a shape of a flat oval disc with an off-center hole 13 matching the hole 11 in the outer fork, and defining at its peripheral wall a transverse hole 21 extending above the hole 13, and being directed thereto at substantially right angles.

The rear side of the joint block 2 is provided with a concave recess 12 for receiving a matching convex portion 7 of a spring 6, as will be explained below.

The inner fork with prongs 22 and 22' is integrally connected to the center portions of long sides of a rectangular razor blade holder 3. The front prong 22 of the inner fork is longer than the rear fork 22', and the prongs are provided with holes 17 and 17' for receiving a pin 4. The holes 17 and 17' are inclined for matching also the hole 21 in the central joint block 2.

So as to allow a maximum tiling movement of the joint block 2, it is provided with an edge 21; the edge 2' normally abuts against the handle 1, so as to prevent a roll-over of the joint block 2 in a clockwise direction.

The assembled razor is illustrated in FIGS. 2 to 4. The razor handle 1, with its outer fork 10 and 10' receives the central block 2, and the pin 5 is inserted into the holes 11 and 13 to form an axle for the central member 2 for tilting in the plane of the handle 1. Pin 4 passes through the holes 22, 21, and 22' and forms an axle for an angular movement of the razor blade holder 3, relative to the handle 1. As can be seen from FIGS. 1 and 3, the rear prong 22' is provided with a flat top surface 16, located below the concave recess 12 of the central member 2; a leaf spring 6 is attached at one and thereof to the rear side of handle 1, whereas its free end is provided with a concave bulge 7, matching the convex recess 12 in the central member 2, and the flat end portion 8 of the spring 6 abuts upon the rest area 16, formed on rear prong 22' of the inner fork.

The upper surface of the blade holder 3 in its central area between the prongs 22 and 22' of the inner fork is provided with a recess for accommodating the lower portion of the central block or member 2. The bottom surface 19 of the blade holder is in sliding contact with the skin and is provided with blades 18 and 18' embedded within the holder 3 and forming with the shaving surface 19, a sharp angle. In the preferred embodiment, as shown in FIG. 3, the blades 18 and 18' extend substantially parallel to the axle 5 of the inner fork 3.

The recess 12 in the central joint member, the rest area 16 of the rear prong 22, and the bulge 7 and 8 of the spring 6, are assembled in such a manner as to keep the resulting universal joint in a normal shaving position in which the user can shave in the same way as with a conventional razor. Due to the action of the spring 6, blades 18 and 18' are substantially at right angles to the handle 1, and cut hairs by shearing.

If the user wishes to change the shearing action of the blade into a slicing action, a rotation of the handle 1 in a clockwise direction will dislodge the spring bulge 7 and the flat edge 8, from the rest position in contact with the blade holder and central block 2, and the universal join will cause the right side of the blade to lead the left side, and the resulting angle will cause a slicing shaving operation instead of the shearing one. If during shaving, the handle 1 is twisted or rotated in a counterclockwise direction, the blade will be angularly displaced to the left, and the slicing action takes place from the opposite direction.

If the pressure of the shaving surface 19 against the skin is released, the spring 6 resumes immediately its normal position in engagement with the recess 12, and the rest surface 16, and thus returns the razor automatically to its normal shaving position.

At the same time, the pin 5 allows the razor blade to tilt between the outer fork 10 and 10' when, by exerting a slight pressure upon the handle 1, the friction between the concave space 17 and the receiving depression 12, is overcome. In this manner, the off-center universal joint in combination with a positioning spring will allow the razor blade holder to keep its normal shaving position of tilt to follow the contour of the face, and it also makes it possible by a simple twist of the handle during the shaving operation to angle the blade to the right or the left.

While the invention has been illustrated and described as embodied in a specific example of a razor blade, it is not intended to be limited to the details shown, since various modifications and structural changes may be made, without departing in any way from the spirit of this invention. For example, the positioning spring could be replaced by other return mechanisms.

What is claimed as new and desired to be protected by Letters Patent, is set forth in the following claims:

1. A razor including a handle and an elongated blade holder with at least one razor blade longitudinally extending substantially parallel to the longitudinal direction of said holder, comprising in combination:

a universal joint having an outer fork firmly connected to one end of said handle, a tiltable central joint member tiltably supported in said outer fork for swinging movement about a first axis, an inner fork firmly connected to said blade holder, said inner fork with the blade holder being tiltably supported in said tiltable central joint member for swinging movement about a second axis, said second axis defining an angle of less than ninety (90°) degrees with said blade holder and extending above said first axis, and disposed in a plane substantially perpendicular to said first axis, and positioning means for resiliency urging said central member and said blade holder to a neutral shaving position.

2. A razor as defined in claim 1, wherein said first axis extends through a marginal part of said central joint member.

3. A razor as defined in claim 2, wherein said second axis extends substantially through a central portion of said central joint member.

4. A razor as defined in claim 3, wherein said first axis extends substantially parallel to the blade holder.

5. A razor including a handle and an elongated blade holder with at least one razor blade longitudinally extending substantially parallel to the longitudinal direction of said holder, comprising in combination a universal joint having an outer fork firmly connected to one end of said handle, a titltable central joint member tiltably supported in said outer fork for swinging movement about a first axis, an inner fork firmly connected to said blade holder, said inner fork with the blade holder being tiltably supported in said tiltable central joint member for swinging movement about a second axis, extending above said first axis, and disposed in a plane substantially perpendicular to said first axis, and positioning means for resiliently urging said central member and said blade holder to a neutral shaving position, wherein said positioning means includes a spring secured at one end thereof to said handle and abutting with its free end portion against the central joint member and said blade holder.

6. A razor as defined in claim 5, wherein said free end portion of said spring is provided with a convex bulge having a straight bottom portion, said central joint member having a correspondingly concave recess for receiving said convex bulge, and said blade holder having a flat area in contact with the straight bottom portion of said bulge.

7. A razor as defined in claim 1, wherein one prong of said inner fork is longer than the other, thereby providing for said angle of said second axis with said blade holder.

8. A razor as defined in claim 7, wherein the top surface of said blade holder has a depression in the area between the prongs of said inner fork for accommodating said outer fork and said central joint member.

9. A razor as defined in claim 7, wherein a first pin means are disposed along at least a portion of said first axis and pass through aligned holes in said first fork and said central member.

10. A razor as defined in claim 9, wherein a second pin means are disposed along at least a portion of said second axis and pass through aligned holes in said second fork and said central joint member.

* * * * *